United States Patent [19]

Grundler

[11] 4,104,749

[45] Aug. 8, 1978

[54] ELECTRICALLY ADJUSTABLE BED FRAME

[75] Inventor: Anthony F. Grundler, San Diego, Calif.

[73] Assignee: Siesta Industries, San Diego, Calif.

[21] Appl. No.: 830,526

[22] Filed: Sep. 6, 1977

[51] Int. Cl.[2] ..... A47C 3/32

[52] U.S. Cl. ..... 5/76; 5/164 D

[58] Field of Search ..... 5/61, 62, 66, 69, 76, 5/78, 164 R, 164 D

[56] References Cited

U.S. PATENT DOCUMENTS

| | | | |
|---|---|---|---|
| 760,153 | 5/1904 | Roberts | 5/76 |
| 1,693,320 | 11/1928 | Smith et al. | 5/76 |
| 3,373,453 | 3/1968 | Goodman | 5/63 |
| 3,821,821 | 7/1974 | Burst et al. | 5/68 |

*Primary Examiner*—Casmir A. Nunberg
*Attorney, Agent, or Firm*—Henri J. A. Charmasson

[57] ABSTRACT

In combination with a bed, a lifting frame inserted between the box-spring and the head section of the mattress for raising the head section to various angular positions relative to the remaining part of the mattress. Two lifting levers are pivotally connected to the lateral elements of the bed frame. On one side of the pivotal points, lifting levers are connected to the lifting frame. The opposite side is pulled down by way of a cable wound around a electrically powered shaft located under the bed frame and extending across the width of the bed. A barrier secured to the box-spring prevent the foot end of the mattress from slipping off the end of the bed when the head section is raised.

8 Claims, 5 Drawing Figures

ELECTRICALLY ADJUSTABLE BED FRAME

BACKGROUND OF THE INVENTION

This invention relates to adjustable beds or so called hospital beds in which certain portions of the mattress supporting frame can be raised to various body supporting positions including elevation of the head. Home use of this type of bed has increased substantially during the last decade. Due to the complexity and bulk of the various mechanisms used in the infrastructure of such adjustable beds, they are usually unatractive and onerous.

SUMMARY OF THE INVENTION

The principal object of this invention is to provide a simple and inexpensive means for tranforming a standard bed into an adjustable bed in which the head section of the mattress can be raised to various angular positions. The mechanism includes a flat frame inserted between the mattress and box-spring, a pair of lifting levers on each side of the bed and an electrically powered lifting mechanism attached to the bed infrastructure.

Another object of this invention is to provide a kit which one can easily assemble at home and install on one's bed in order to transform said bed into an adjustable one.

IN THE DRAWING

DESCRIPTION OF THE PREFERRED EMBODIMENT OF THE INVENTION

Figure 1:
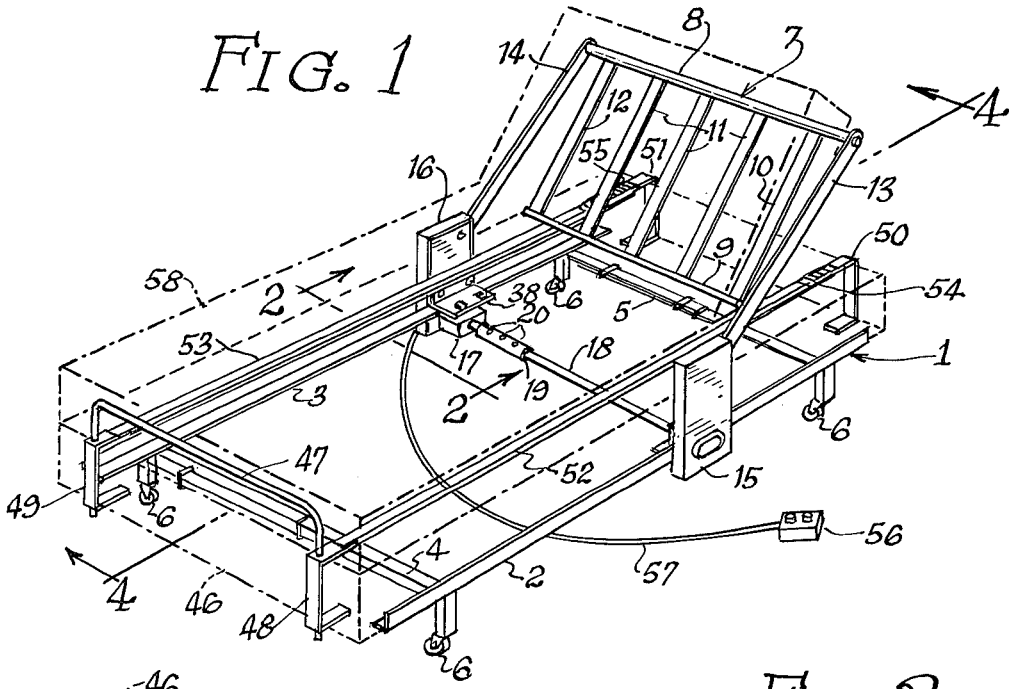
FIG. 1 is a perspective view of the invention installed upon a bed frame.
Figure 2:
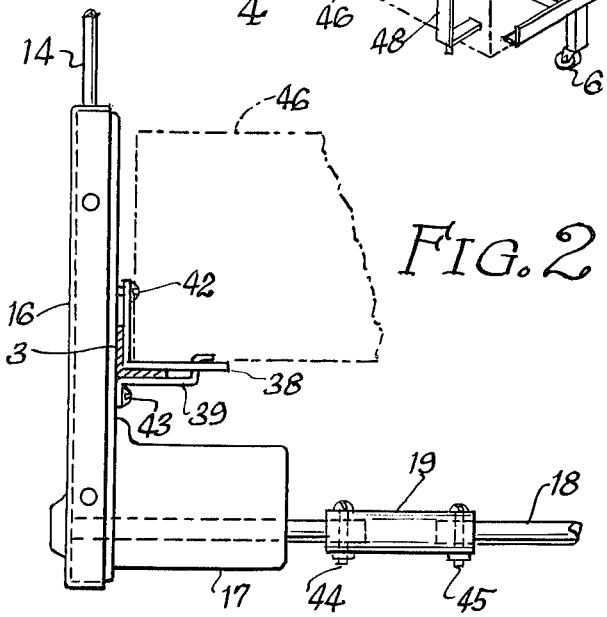
FIG. 2 is a front elevation of the right hand lift mechanism enclosure showing its means of attachment to the bed frame.
Figure 3:
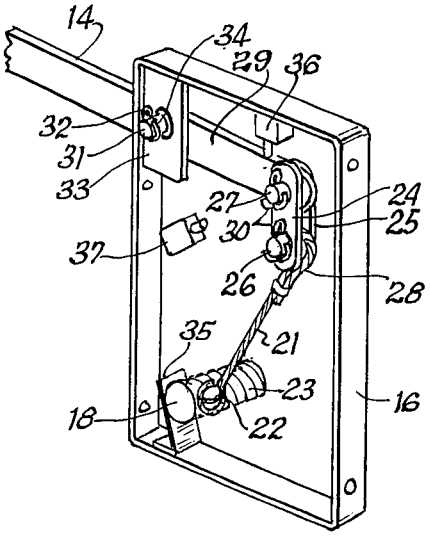
FIG. 3 is a perspective view of the inside of the right hand lift mechanism enclosure.
Figure 4:
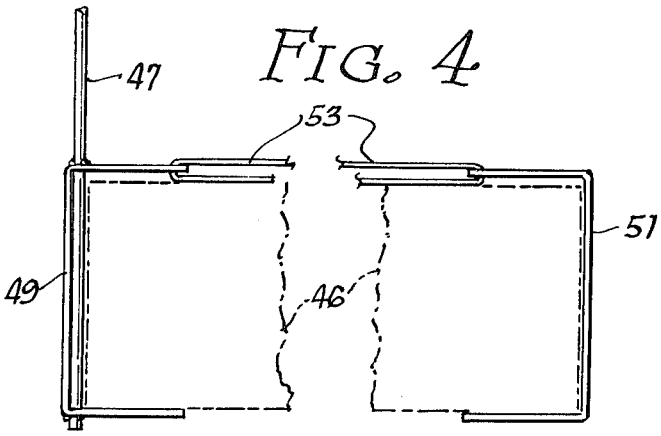
FIG. 4 is a cross-sectional view taken along line 4—4 of FIG. 1 showing the mattress retaining assembly.
Figure 5:
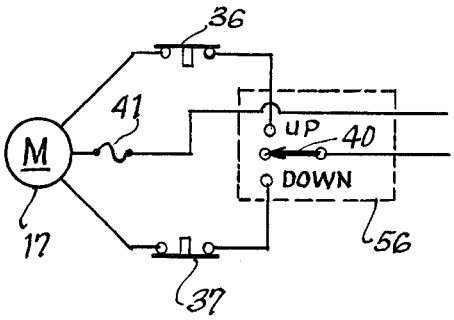
FIG. 5 is a diagram of the electrical system.

Referring now to the drawing, there is illustrated a standard bed frame 1 supporting a box-spring 46 and a mattress 58. The bed frame 1 comprises a pair of angular lateral elements 2, 3 linked by two adjustable cross-members 4, 5 and four feet 6 mounted on casters. Common box-springs such as the one illustrated here are usually built within a rigid frame and cannot be bent or folded. Common mattresses on the other hand are flexible and can be folded across their latitudinal mid-section.

The illustrated invention comprises a flat lifting frame 7 inserted between the box-spring 46 and the head-section of the mattress 58 designed to raise the head-section of the mattress 58 to various angular positions relative to the box-spring 46 and the remaining section of the mattress 58. The lifting frame 7 includes a horizontal upper member 8, a lower member 9 and a plurality of vertical rigid elements 10, 11, 12 linking the upper and lower members 8, 9. The invention would also apply to beds featuring other types of foundations such as leaf-springs, webbing frame or non resilient support.

A pair of lifting levers 13, 14 have one end pivotally connected to opposite sides of the lifting frame 7. The other ends of the lifting levers 13, 14 are engaged into two enclosures 15, 16 housing part of the lifting mechanism.

Enclosure 16 is mounted near the mid-section of the lateral element 3 of the bed frame 1 and secured thereon by brackets 38, 39 held by nut and screw combinations 42, 43. The other enclosure 15 is similarly mounted on the lateral element 2 on the left side of the bed, opposite enclosure 16. Within each enclosure 15, 16 the lifting lever 13, 14 is pivotally connected to a bracket 33 by a clevis pin 31 inserted through hole 34 and secured by cotter pin 32. Hole 34 has a lubricated bearing eliminating friction. This arrangement produces a horizontal axis of rotation common to both lifting levers 13, 14, extending across the width of the bed.

A short section 29 of each lifting levers 13, 14 extends beyond this axis of rotation and is connected to a steel cable 21 by means of a linking assembly. The linking assembly comprises two linking plates 24, 25 held by two pins 26, 27 secured by cotter pins 30. One pin 26 engages in a loop 28 at the end of the steel cable 21. The other pin 27 engages a hole at the end 29 of the lifting lever 13, 14. Both the lever end and the cable loop 28 are sandwiched between the linking plates 24, 25. Both steel cable 21 are wound around a shaft 18 which extends across the width of the bed and under the bed frame 1 through the two enclosures 15, 16.

The shaft 18 has at each extremity a helicoidal grooved section 23 to capture the steel cable 21 as it wraps around it during the head raising operation. The cable 21 is attached to the shaft 18 by a screw 22. A small leaf spring 35 pushing against the shaft 18 in the area of the cable connecting screw 22 assures a smooth winding of the cable 21 around the grooved area 23 of the shaft 18. The shaft 18 is made of two sections linked by a coupling sleeve 19 having a series of transversal holes across its length. The sleeve is used to adjust the length of the shaft 18 to the width of the bed frame 1. In the right hand enclosure 16 the shaft 18 is coupled to the rotor of a bidirectional electrical motor 17.

The operation of the electrical motor 17 is controlled by a 3 position switch 40 mounted on a remote control module 56 connected to the motor 17 by an electrical power cord. Two contact switches 36, 37 mounted within the right hand enclosure 16 are opened by contact with the end section 29 of lifting lever 14 when it reaches its maximum up and down excursions. The switches are designed to cut off the electrical power supply to the bidirectional motor 17. The electrical system is powered by standard household alternating current and is protected by a thermal overload protector within the motor 17.

Turning switch 40 to the "UP" position causes a rotation of the shaft 18. As the cables 21 wind around the ends 23 of the shaft 18 the lifting levers 13, 14 push the lifting frame 7 upward until the switch 40 is returned to its neutral position, or until switch 37 is activated when the levers 13, 14 reach their maximum lifting excursion. When the switch 40 is moved to the "DOWN" position the shaft 18 rotates in the opposite direction, unwinding the cables 21 and causing the lifting frame 7 to fall back toward the box-spring 46 until the switch 36 is activated or until the control switch 40 is returned to the neutral position.

The bedirectional motor 17 is equipped with a friction brake of the type well known to those versed in the electromechanical arts. The friction brake prevents the shaft 18 from turning, when the motor is not energized, under the torque action created by the weight of the mattress and bed user, which torque is transmitted to the shaft 18 by the lifting levers 13, 14 and cables 21 arrangement. The friction brake thus permits the bed user to adjust the lifting frame to any convenient intermediate angular position.

The box-spring 46 illustrated in the drawing is equipped with a mattress retaining assembly in order to prevent the mattress 58 from slipping down toward the foot of the bed when the head section is raised. Such a retaining assembly may be dispensed with when the bed has a foot board attached to the frame.

The mattress retaining assembly comprises a pair of U-shaped brackets 50, 51 engaging the head-end of the box-spring 46 and a second pair of U-shaped brackets 48, 49 engaging the foot-end of the box-spring 46. Each of the head-end brackets is tied to one of the foot-end brackets by an adjustable strap 52, 53 running longitudinally across the top of the box-spring 46. Each strap 52, 53 forms a loop engaging holes in the end of the brackets. The loop is closed by a buckle 54, 55 by which the strap may be tightened in order to firmly secure the end brackets 48, 49, 50, 51. The foot-end brackets 48, 49 are bridged by a retaining bar 47 mounted above them so as to form a barrier to the mattress 58.

While I have described various features of the present invention, it should be understood that modification may be made without departing from the spirit and scope of the appended claims.

What is claimed is

1. In a bed comprising a mattress, a foundation under the mattress and a supporting frame having two lateral horizontal elements along each side of the foundation, a device for raising the head section of the mattress to various angular positions which comprises:

a flat lifting frame inserted between the foundation and the head section of the mattress;

a pair of lifting levers at opposite sides of the bed, each having one end pivotally connected to the lifting frame whereby the lifting frame is free to rotate around a first horizontal axis joining one said end of each lifting lever to the other;

means for pivotally connecting each lifting lever to the lateral horizontal elements at points which produce a second horizontal axis of rotation extending across the width of the bed; and means for pivotally moving the lifting levers about said second horizontal axis whereby the first horizontal axis of the lifting frame is pushed upward by the lifting levers or allowed to fall back toward the foundation.

2. The device claimed in 1 wherein said means for pivotally moving comprise:

a rotating shaft extending across the width of, and under, the bed;

means for pulling the opposite ends of each lifting levers with the rotation of the shaft; and means for bidirectionally rotating the shaft.

3. The device claimed in 2 wherein said means for pulling comprise:

at least one cable having one end wound around one of the extremities of the shaft and the other end attached to one of the lifting levers.

4. The device claimed in 3 wherein said means for bidirectionally rotating the shaft comprise an electrical motor.

5. The device claimed in 4 wherein the lifting frame comprises:

a horizontal upper member connected at each end to the lifting levers;

a horizontal lower member; and a plurality of vertical elements linking the upper and lower members.

6. The device claimed in 4 wherein said means for pivotally connecting comprise a pair of enclosures each mounted near the midsection of one of the lateral elements, each said enclosure comprising a bracket, a pin pivotally connecting one of the lifting levers to the bracket, and at least one of said enclosure further housing said cable and one of the extremities of the shaft.

7. The device claimed in 2 which further comprises a means for preventing the mattress from slipping comprising a first pair of U-shaped bracket engaging the head-end of the foundation;

a second pair of U-shaped bracket engaging the foot-end of the foundation.

a pair of adjustable straps each running longitudinally across the top of the foundation tying one of the head-end brackets to one of the foot-end brackets; and a retaining bar mounted above and between the foot-end brackets.

8. The device claimed in 2 wherein said means for pulling comprise:

two cables each having one end wound around one of the extremities of the shaft and the other end attached to one of the lifting levers;

said means for bidirectionally rotating comprise:

at least one electrical motor driving the shaft;

said means for pivotally connecting comprise a pair of enclosures each mounted near the mid-section of one of the lateral elements, each said enclosure comprising a bracket, a pin pivotally connecting one of the lifting levers to the bracket; and each said enclosure housing one of the cables and one of the extremities of the shaft.

* * * * *